US006147327A

United States Patent [19]

Winn

[11] Patent Number: 6,147,327

[45] Date of Patent: Nov. 14, 2000

[54] HOT SHELF TOWER DRYER FOR A COTTON GIN USING HEATING ELEMENTS

[76] Inventor: William E. Winn, P.O. Box 702, Levelland, Tex. 79336

[21] Appl. No.: 09/099,432

[22] Filed: Jun. 18, 1998

Related U.S. Application Data

[60] Provisional application No. 60/051,421, Jul. 3, 1997.

[51] Int. Cl.[7] ..... F26B 13/06

[52] U.S. Cl. ..... 219/388; 19/0.27; 34/369; 34/360; 34/576; 34/588; 392/493; 432/132

[58] Field of Search ..... 219/388; 392/417, 392/493, 492; 19/0.27; 34/369, 363, 360, 576, 582, 583, 588; 432/132, 148

[56] References Cited

U.S. PATENT DOCUMENTS

| | | | |
|---|---|---|---|
| 945,904 | 1/1910 | Barrett | 392/493 |
| 1,235,003 | 7/1917 | Bowman | 432/132 |
| 1,871,773 | 8/1932 | Bennett | 34/369 |
| 1,899,397 | 2/1933 | Reiche . | |
| 1,998,210 | 4/1935 | Underwood | 34/369 |
| 2,190,565 | 2/1940 | Joyce | 34/369 |
| 2,266,640 | 12/1941 | Joyce | 34/369 |
| 2,968,874 | 1/1961 | Fishburn . | |
| 4,031,593 | 6/1977 | Vanderfriff | 19/27 |
| 4,143,470 | 3/1979 | Vandergriff | 34/10 |
| 4,525,936 | 7/1985 | Hauck . | |
| 5,023,429 | 6/1991 | Bailey et al. . | |
| 5,233,764 | 8/1993 | Vandergriff | 34/10 |

FOREIGN PATENT DOCUMENTS

| | | | |
|---|---|---|---|
| 530344 | 12/1921 | France | 392/493 |
| 52434 | 4/1944 | France | 392/492 |
| 495528 | 4/1930 | Germany | 219/388 |
| 650855 | 10/1937 | Germany | 392/492 |
| 21 63 368 | 6/1973 | Germany . | |
| 3-230083 | 10/1991 | Japan . | |
| 881469 | 11/1981 | U.S.S.R. | 392/493 |
| 397666 | 3/1934 | United Kingdom . | |

OTHER PUBLICATIONS

"Customer Infrared Oven Systems", Fannon Products, undated.

*Primary Examiner*—John A. Jeffery
*Attorney, Agent, or Firm*—Finnegan Henderson Farabow Garrett & Dunner, LLP

[57] ABSTRACT

A hot shelf tower dryer includes a casing having substantially parallel shelves which alternately extend from opposite ends of the tower casing. As configured, the dryer includes a repetitively convoluted passage. At least one of the shelves has a hollow interior or chamber. Disposed in the chamber is at least one electrical heating element, where the power supplied to the heating element is regulated by a control system. As controlled, the electrical heating elements provide sufficient output to the tower casing which result in a substantially constant temperature throughout the passage. With the heating elements, the hot shelf tower dryer does not require the burning of natural gas or some other fossil fuel to heat the tower dryer unless such heating is desired to heat the forced air that conveys the cotton through dryer. As a result, in comparison with hot shelf tower dryer's that use fossil fuels as a heating source, pollutant emissions, such as nitrous oxide ($NO_x$) emissions, are eliminated or at least significantly reduced.

11 Claims, 7 Drawing Sheets

HOT SHELF TOWER DRYER FOR A COTTON GIN USING HEATING ELEMENTS

This application claims benefit of provisional application 60/051,421, filed Jul. 3, 1997.

BACKGROUND OF THE INVENTION

1. Field of the Invention

The present invention relates to the design and operation of a hot shelf tower dryer for a cotton gin. More specifically, the present invention concerns the placement of electrical heating elements at specific locations within a hot shelf dryer to augment the drying power of such a dryer.

2. Description of the Prior Art

Since it was invented by Eli Whitney more than a century ago, the cotton gin has remained the primary tool used to remove extraneous material, more commonly known as "trash," from newly-picked cotton. The "trash" removed typically includes seeds and other parts of the cotton plant that are collected together with the raw cotton when it is harvested. This "trash" must be separated from the cotton fibers before the fibers can be processed into thread and, ultimately, into fabric.

Cotton, however, is not ginned immediately after it is picked. Instead, among other pre-ginning processes, high moisture seed cotton is first partially dried in various types of apparatus known as a hot shelf tower dryer or a seed cotton dryer of some other type. The hot shelf tower dryer is a direct application of the knowledge that cotton is more easily ginned if a significant portion of the moisture contained in the cotton is first removed.

To dry cotton, the conventional hot shelf tower dryer includes a vertical tower casing, with substantially parallel shelf partitions. These shelf partitions alternately extend from one end wall of the tower casing to a location near the opposite end wall. So configured, the shelf partitions define a continuous zig-zag passage through the tower casing that guarantees a sufficient amount of drying by ensuring that the cotton remains in the dryer for a selected period of time at a desired temperature or range of temperatures.

In the conventional seed cotton dryer, cotton and heated air initially enter the hot shelf tower dryer through an inlet, located proximate to the top of the tower casing. The heated air carries the cotton through the convoluted path in the dryer to the outlet. As the cotton, which may have an initial moisture content of between about 15% to 20%, passes through the dryer, moisture is progressively driven from the cotton until the cotton exits the dryer with a moisture content of between about 11% to 16%. As many as three or four subsequent drying stages are needed to bring the cotton to a desired moisture content of between about 5½% to 6½%.

The heated air that carries the cotton through the dryer is inadequate, by itself, to dry the cotton sufficiently before it exits the dryer. This is because the initial exposure of wet cotton to the heated air results in a rapid evaporation of moisture from the seed cotton that robs the heated air of a significant portion of its thermal drying energy. As a result, the air becomes cooler. To compensate for the loss of drying energy associated with a reduced temperature, conventional hot shelf tower dryers include heated air ducts inside the shelves over which the seed cotton travels, as depicted in FIGS. 2 and 3. The heated air provided to these ducts or chambers supplies additional heat to the air in the tower casing to augment the drying process.

Both U.S. Pat. No. 4,031,593 and U.S. Pat. No. 5,233,764 describe hot shelf tower dryers with heated shelves that assist in drying seed cotton. As these disclosures provide, the shelves are heated by hot air circulated in the hollow interior chambers of the shelves. A push fan, which receives heated air from a remote heater, directs the heated air to and circulates this heated air within the shelf chambers.

In the conventional dryer design, because the heated air is generated remotely, there is a heat loss associated with the conveyance of the hot air to the shelf chambers. Depending upon the distance that the heated air must travel, this heat loss may be significant. The heater, as a result, must compensate for this temperature drop and, consequently, must increase the temperature of the heated air to a point higher than that required by the individual shelf chambers.

Typically, to attain a temperature of approximately 400° F. in a chamber proximate to the inlet, a conventional heater, positioned beneath the outlet, may require an output temperature of approximately 900° F. As expected, to attain such an increased level of heat requires the addition of a significant amount of energy to the heater.

Traditionally, natural gases or other fossil fuels have been used to heat the air for a seed cotton dryer. These natural resources, however, do not enjoy an unlimited surplus. As such, their consumption in providing the additional power to the heater involves both monetary as well as environmental waste.

In addition, these resources entail a fuel burning process that produces numerous pollutants in the form of gaseous emissions, such as nitrous oxide ($NO_x$), the production of which has become increasingly restricted in an increasingly environmentally-conscious marketplace. The state of California is one such area where stringent regulations regarding fuel emissions have been implemented.

In this increasingly environmentally-conscious marketplace, the use of conventional burners to supply heat to the hot shelf tower dryer has become increasingly less desirable. The inability of the traditional hot shelf tower dryer and any other drying system to incorporate features that continue to provide the appropriate amount of cotton drying while reducing the amount of fuel consumed as well as the amount of fuel emissions produced has created a specific need for alternative techniques for mitigating temperature loss.

The present invention addresses these concerns by providing an apparatus that is practical and adaptable in both its design and application.

SUMMARY OF THE INVENTION

The advantages and purpose of the invention will be set forth in part in the description which follows, and in part will be obvious from the description, or may be learned by practice of the invention. The advantages and purpose of the invention will be realized and attained through the elements and combinations of elements particularly pointed out in the appended claims.

To attain the advantages and in accordance with the purpose of the invention, as embodied and broadly described herein, the hot shelf tower dryer of the present invention includes a casing having opposed end walls, an inlet and an outlet. The casing further includes a plurality of shelves disposed in generally parallel, spaced relation between the inlet and the outlet. Each shelf alternately extends from one end wall to a location proximate the opposing end wall to define a convoluted passage between the inlet and the outlet. The tower casing receives seed cotton through the inlet and conveys the seed cotton through the passage which leads to the outlet. At least one shelf includes a chamber. Disposed in the chamber is at least one electrical heating element, the power supply to which is regulated by a control system.

In another aspect of the present invention, the hot shelf tower dryer includes seven shelves, each provided with a chamber. Each of the seven chambers includes a floor. Eighteen electrical heating elements are disposed on the floor of each of the seven chambers. The power supplied to the electrical heating elements is regulated by a control system so that the one hundred twenty-six electrical heating elements dispersed throughout the seven chambers produce a total output of approximately 1.5 million BTU, or equivalently 439 KW. This output from the electrical heating elements corresponds to an air temperature range in each chamber of approximately 150° to 400° F. The heat transferred from the chambers helps to maintain an air temperature in a range of about 150° F. to about 250° F. throughout the cotton passage of the tower casing.

In yet another aspect of the invention, each of the seven chambers includes a ceiling in addition to the floor. Eighteen electrical heating elements are disposed on the floor as well as the ceiling of each of the seven chambers. The power supplied to the electrical heating elements is regulated by a control system so that the two hundred fifty-two electrical heating elements dispersed throughout the seven chambers produce a total output of approximately 3 million BTU, or equivalently 878 KW. This output from the electrically-powered radiant heating elements corresponds to an air temperature range in each chamber of approximately 250° to 600° F. The heat transferred from the chambers helps to maintain an air temperature in a range of about 150° F. to about 250° F. throughout the cotton passage of the tower casing.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate preferred embodiments of the invention and together with the description, serve to explain the principles of the invention. In the drawings.

DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Illustrative of conventional hot shelf tower dryers are the following references: (1) U.S. Pat. No. 4,031,593, issued to Vandergriff on Jun. 28, 1997; (2) U.S. Pat. No. 4,143,470, issued to Vandergriff on Mar. 13, 1979; and (3) U.S. Pat. No. 5,233,764, issued to Vandergriff on Aug. 10, 1993. The disclosures of each of these three patents are incorporated herein by reference. All three references discuss various aspects of hot shelf tower dryers for a cotton gin.

In accordance with the present invention, there is provided a hot shelf tower dryer for conditioning seed cotton for ginning that includes a casing having opposed end walls, an inlet and an outlet. The casing further includes a plurality of shelves disposed in a generally parallel, spaced relation between the inlet and the outlet. Each shelf alternately extends from one end wall to a location proximate the opposing end wall to define a convoluted path between the inlet and the outlet. The inlet receives seed cotton for pneumatic conveyance through the passage which leads the seed cotton to the outlet of the casing. Generally, at least one shelf includes a chamber. Disposed within the chamber is at least one electrical heating element, regulated by a control system.

Figure 1:
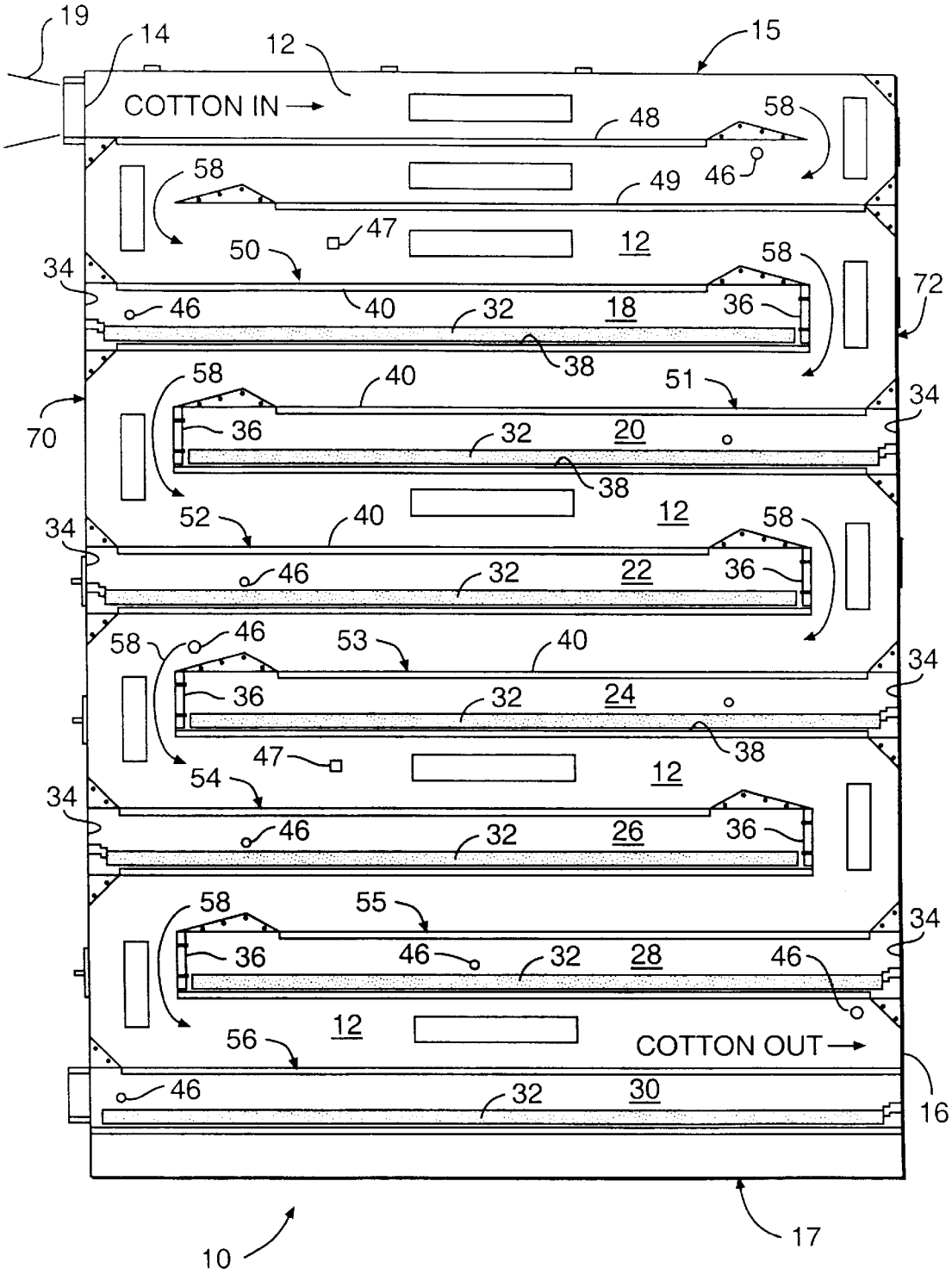
FIG. 1 is a side view illustration of a preferred embodiment of the hot shelf tower dryer according to the present invention, showing the location of the electrical heating elements.
Figure 2:
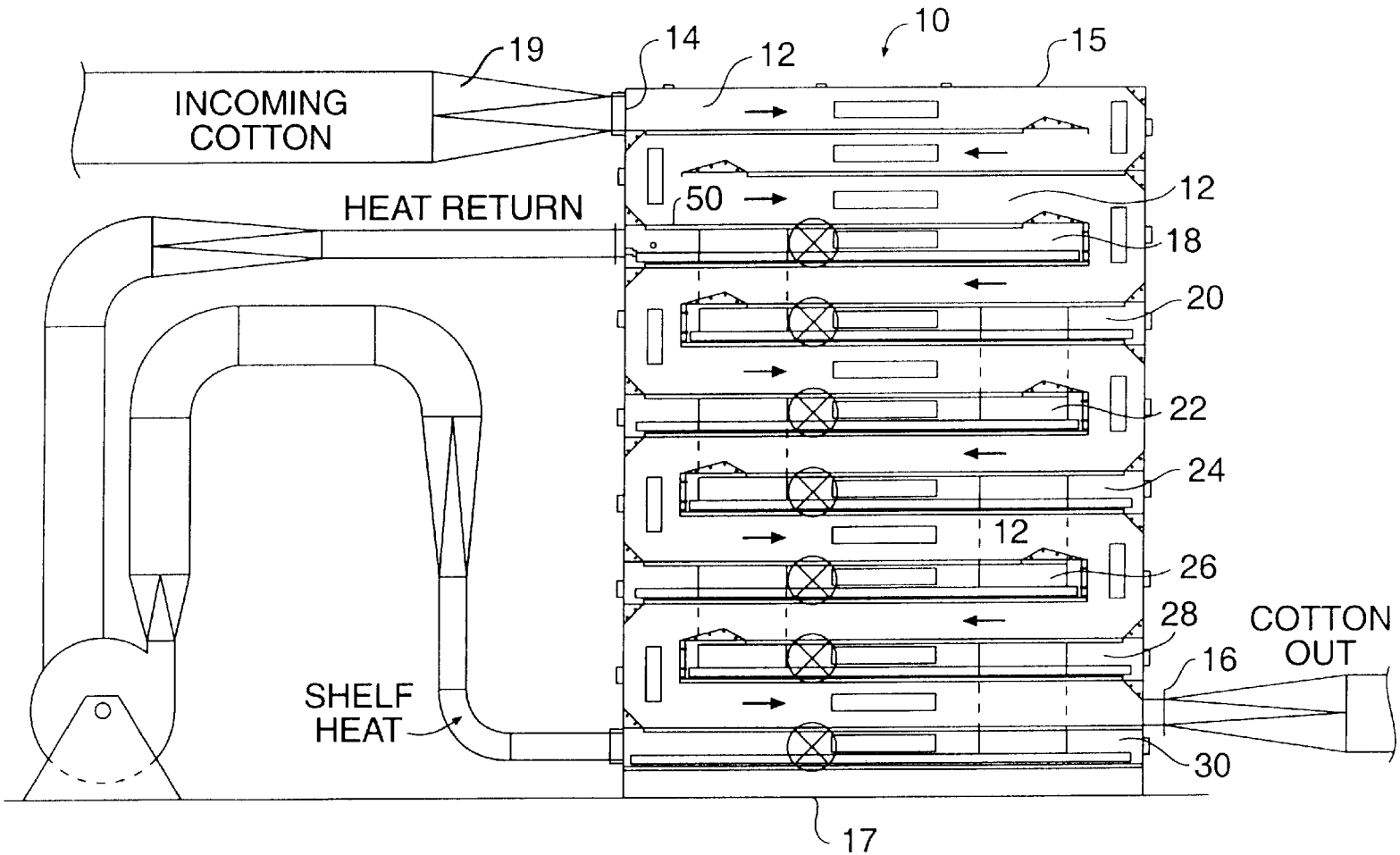
FIG. 2 PRIOR ART
FIG. 2 is a side view illustration of a conventional hot shelf tower dryer, indicating with an "x" the location of each hot air chamber.
Figure 3:
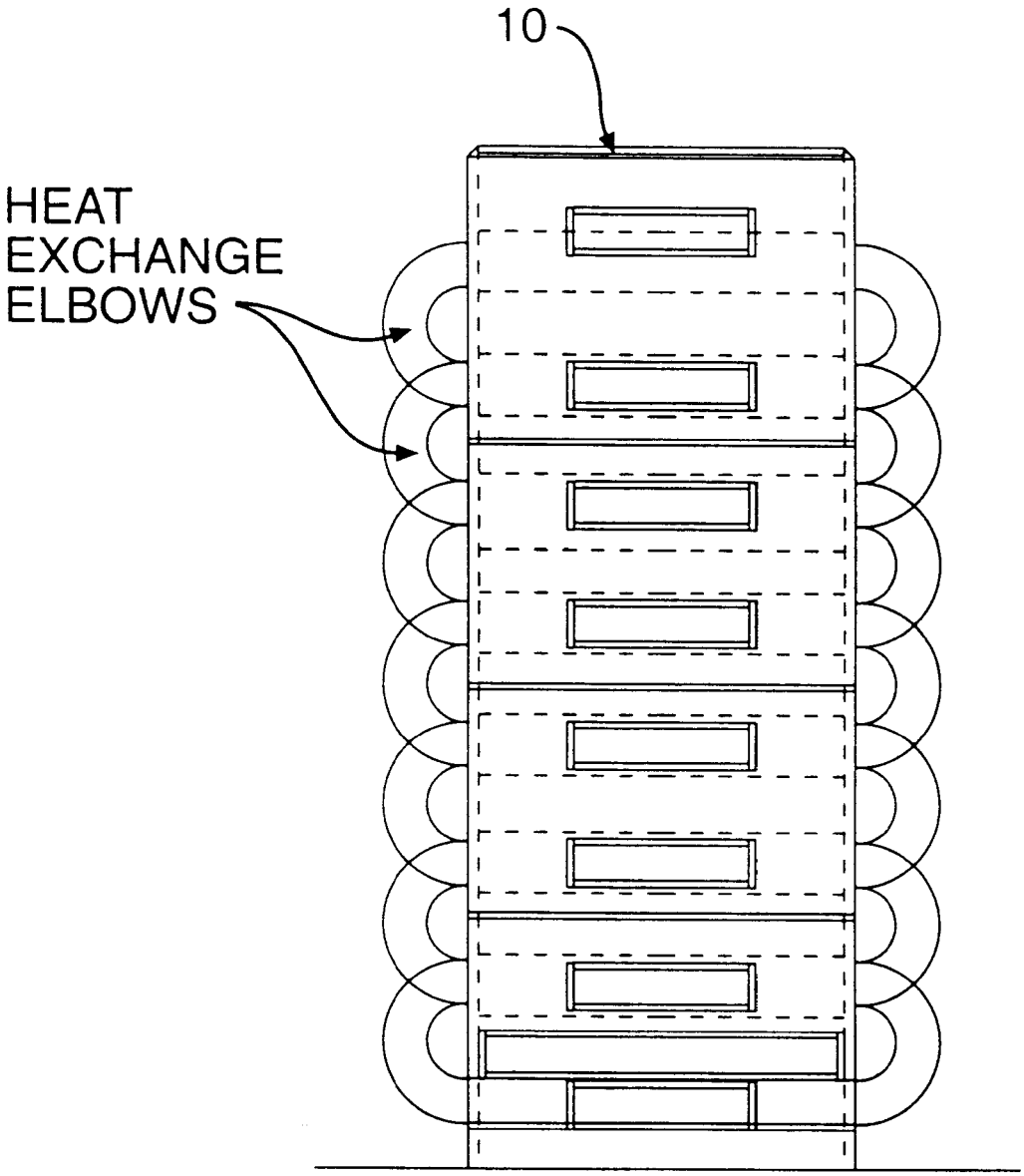
FIG. 3 PRIOR ART
FIG. 3 is an end view illustration of the conventional hot shelf tower dryer.

The preferred embodiment of the hot shelf tower dryer of the present invention is depicted in FIG. 1. As illustrated, the hot shelf tower dryer includes tower casing 10 for conditioning the seed cotton. Tower casing 10 includes a conveying passage 12, which extends from inlet 14, located at top portion 15 of tower casing 10, to outlet 16, located at bottom portion 17 of tower casing 10. Inlet 14 receives seed cotton as well as heated forced air from air duct 19. The heated forced air pneumatically conveys the seed cotton from inlet 14 through passage 12 to outlet 16. Customarily, the incoming seed cotton has a high moisture content of about 15% to about 20%. The hot shelf tower dryer of the present invention conditions the seed cotton, so that once it is expelled from outlet 16 the seed cotton possesses a sufficiently reduced moisture level. This reduced moisture level greatly improves further processing of the seed cotton.

As depicted in FIG. 1, passage 12 traverses a repetitively convoluted path. This convoluted path is defined by nine shelves 48, 49, 50, 51, 52, 53, 54, 55, 56, although more or fewer could be used, where each shelf lies substantially parallel to one another. The shelves alternately extend from one end wall of tower casing 10 to a location proximate to the opposing end wall of tower casing 10. For example, as shown in FIG. 1, shelves 48, 50, 52, 54 originate from end wall 70 of tower casing 10 and terminate short of opposing end wall 72 of tower casing 10. Similarly, shelves 49, 51, 53, 55 originate from end wall 72 and terminate short of opposing end wall 70. As positioned, the shelves create a continuous zig-zag flow path 58 that originates at top portion 15 and concludes at bottom portion 17 of tower casing 10.

The velocity of the heated forced air pneumatically conveys the seed cotton over the surface of the shelves, along zig-zag flow path 58.

It will be apparent to those skilled in the art that various modifications and variations can be made in the configuration as well as the number of shelves forming the repetitive convolutions of passage 12. For example, as described in U.S. Pat. No. 4,031,593, the shelf spacing may increase at a progressively predetermined amount from each shelf to the next from top portion 15 to bottom portion 17 of tower casing 10, so that passage 12 provides an increasing cross-sectional passage from top portion 15 to bottom portion 17. Further, instead of each shelf being substantially parallel to one another, the shelves may be positioned at either an incline or a decline. The angle of the shelf may potentially effect the velocity of the heated forced air conveying the seed cotton through passage 12. Thus, depending upon the angle, the conveyance of the seed cotton through passage 12 may require either a shortened or extended period of time.

Of the nine shelves defining passage 12, preferably, seven of the shelves 50–56 include hollow interior chambers 18, 20, 22, 24, 26, 28, 30. The chambers may be manufactured by any conventional means, where each chamber 18–30 includes floor 38 and ceiling 40. Further, each of the seven chambers 18–30 preferably encompass dimensions of approximately 10 inches in height, 72 inches in width, and 10 feet in length.

To compensate for the temperature drop in the drying air resulting from the evaporation of moisture from the seed cotton, it is preferred that eighteen electrical heating elements 32 be disposed on floor 38 of each of the chambers 18–30. The electrical heating elements 32 generate heat that is transferred from chambers 18–30 to shelves 50–56 and passage 12 to mitigate the temperature loss experienced by the heated forced air.

Figure 8:
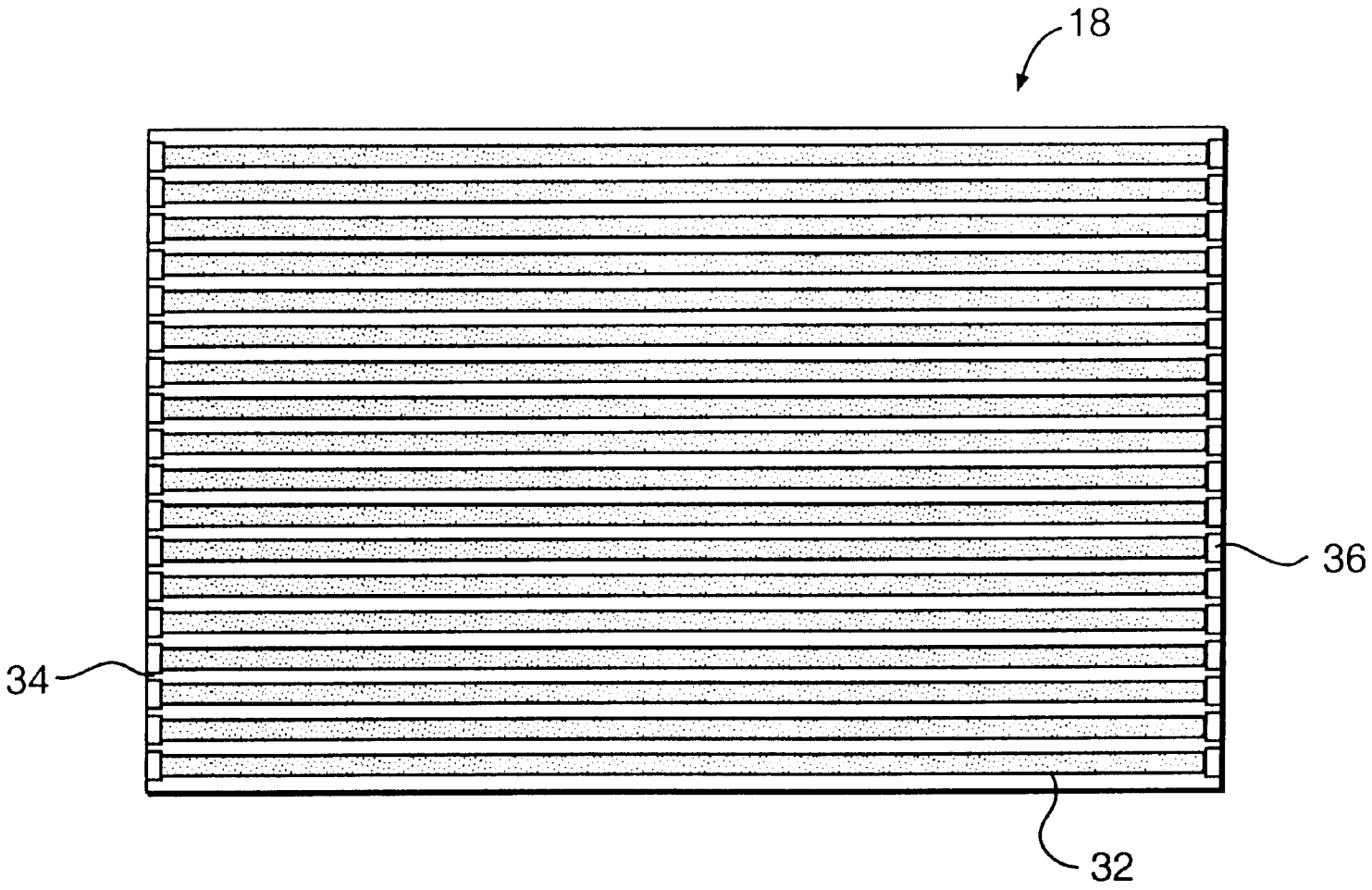
FIG. 8 is a top view illustration of the preferred embodiment of the arrangement of electrical heating elements disposed in the chamber of the hot shelf tower dryer according to the present invention.

The electrical heating elements 32 preferably span the length of the chamber in which they are placed. Thus, as depicted in FIG. 8, electrical heating elements 32 disposed in chamber 18 extend between outer wall 34 and inner wall 36 of chamber 18. As positioned, electrical heating elements 32 measure approximately 10 feet in length with a preferable diameter of about ⅜ inch to about ⅝ inch.

The preferred embodiment, as described above, includes a total of 126 individual electrical heating elements 32 dispersed throughout chambers 18–30 of tower casing 10. Generally, one hundred twenty-six electrical heating elements 32 will produce a total output of approximately 1.5 million BTU, or equivalently 439 KW. Such an output corresponds to a chamber air temperature in the range of approximately 150° F. to 400° F., which typically provides sufficient heat transfer radiating throughout casing 10 to maintain the temperature range of the heated forced air at approximately 150° F. to approximately 250° F. throughout passage 12.

It will be apparent to those skilled in the art that various modifications can be made in the placement and number of electrical heating elements 32 disposed in the chambers of tower casing 10. For example, instead of disposing electrical heating elements 32 in each of seven chambers 18–30, tower casing 10 may include as little as one chamber provided with electrical heating elements 32. Further, instead of eighteen electrical heating elements 32 disposed in each chamber, as little as one electrical heating element 32 may be disposed in each individual chamber 18–30.

Such design decisions will be apparent to those skilled in the art depending upon factors, such as the output capacity of the electrical heating elements 32, the temperature drop in the drying air as it travels through passage 12, and the heat transfer characteristics of the chamber, shelf and passage.

Certain design considerations may further require a temperature profile within tower casing 10. As such, certain chambers may include an increased or decreased number of electrical heating elements 32 depending upon the desired heat transfer requirements. For example, to further increase the output of heat provided by electrical heating elements 32, at least one of the seven chambers may include additional electrical heating elements 32 disposed on ceiling 40 of the chamber. Because of the dimensions of both chamber 18 and electrical heating elements 32, several electrical heating elements 32 may be arranged in any one chamber to provide additional heat to tower casing 10.

In circumstances which require additional heat, each of the seven chambers may include an additional set of eighteen electrical heating elements, resulting in a total of 252 electrical heating elements 32 in the tower casing. Generally, two hundred fifty-two electrical heating elements 32 will produce a total output of approximately 3 million BTU which in turn results in significantly increased temperatures in the chambers, the shelves, and passage 12. For example, an output of 3 million BTU corresponds to a chamber air temperature in the range of approximately 250° F. to 600° F. Although the chamber air temperature range has increased, the temperature of the heated forced air remains in the range of approximately 150° F. to 250° F. throughout passage 12. Assuming the hot shelf tower dryer requires even more heat, additional heating elements may be provided to the tower casing to produce an output of 6 million BTU or more.

Because the amount of BTU output is a direct correlation to the amount of mass that is subject to a degree of moisture, such design decisions will be apparent to those skilled in the art depending upon factors, such as the necessary BTU output to vaporize a specific amount of liquid mass into gas.

Figure 9:
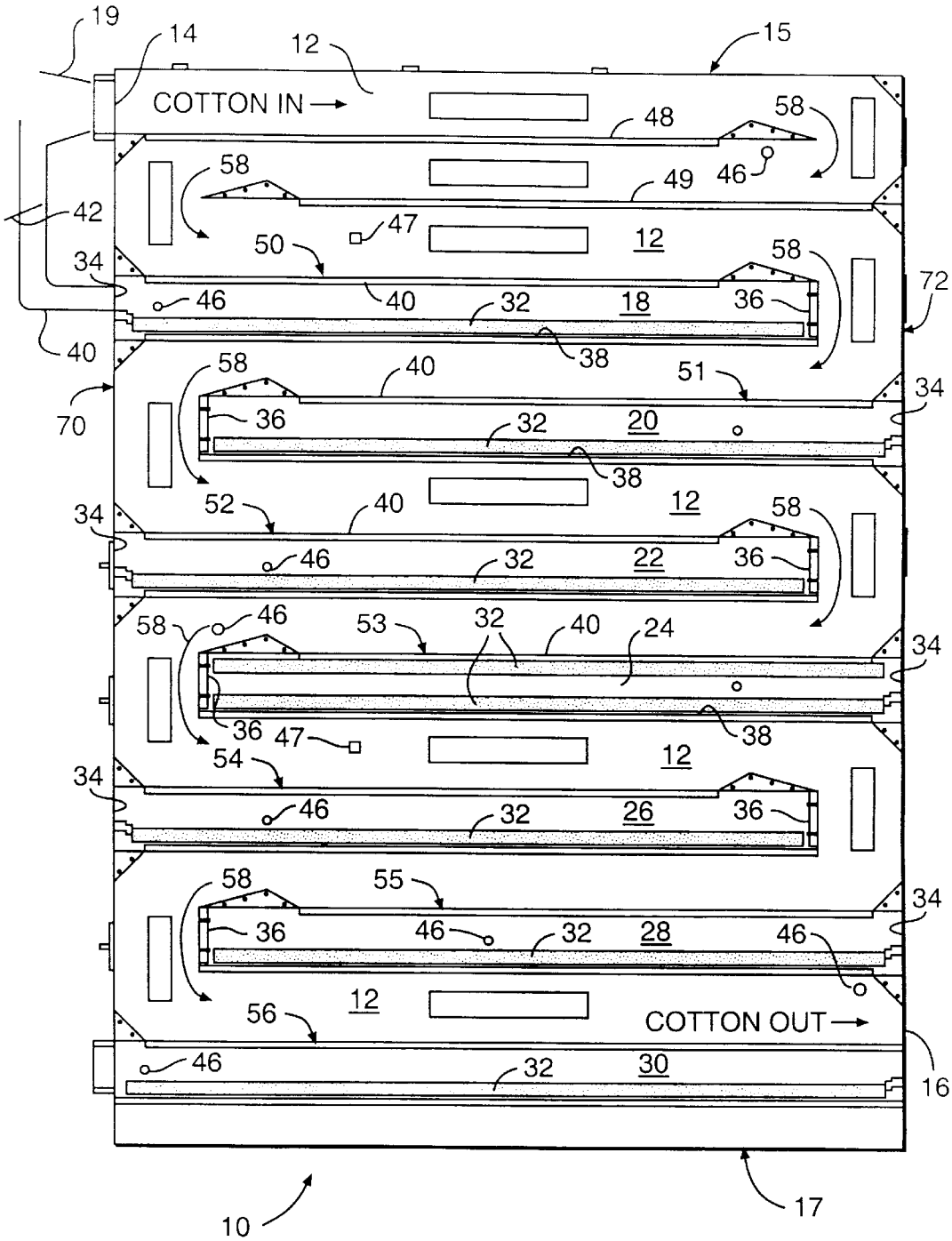
FIG. 9 is a side view illustration of a variation of the preferred embodiment of the hot shelf tower dryer according to the present invention.

The provision of increased BTU output may also involve the skimming off of air heated in the chamber to inlet 14, passage 12, or other areas of the hot shelf tower dryer, as explained in the previously mentioned patents issued to Vandergriff. Inherent in the drying process is the ability to dry high moisture seed cotton at a higher temperature than the low moisture seed cotton. To further facilitate this end and enhance the drying of the seed cotton, the hot shelf tower dryer could include channel 40 positioned between chamber 18 and air duct 19, as illustrated in FIG. 9. As provided, channel 40 removes a portion of the heated air resident in chamber 18 to air duct 19 and inlet 14 to expose the high moisture seed cotton entering casing 10 to a higher air temperature. To assist in the removal of the heated air, chamber 18 could include a fan 70 positioned to direct the heated air through transition 40. To regulate the temperature of the heated air entering inlet 14, channel 40 includes valve 42 which controllably allows heated air from chamber 18 to skim off and enter air duct 19. Valve 42 may be controlled to allow some or all of the heated air from chamber 18 to travel to air duct 19 and inlet 14. Although only one channel 40 is illustrated in FIG. 9, the hot shelf tower dryer of the present invention may include one or more channels connected to one or more chambers depending upon the particular design considerations. Such design decisions will be apparent to those skilled in the art.

In situations where increased heat is desired only at a specific portion of the tower casing, such as top portion 15 of tower casing 10, only those chambers proximate to top portion 15 would require thirty-six electrical heating elements 32, while the remaining chambers would require only eighteen electrical heating elements 32. Again, such temperature profile design considerations will be apparent to those skilled in the art.

Figure 7:
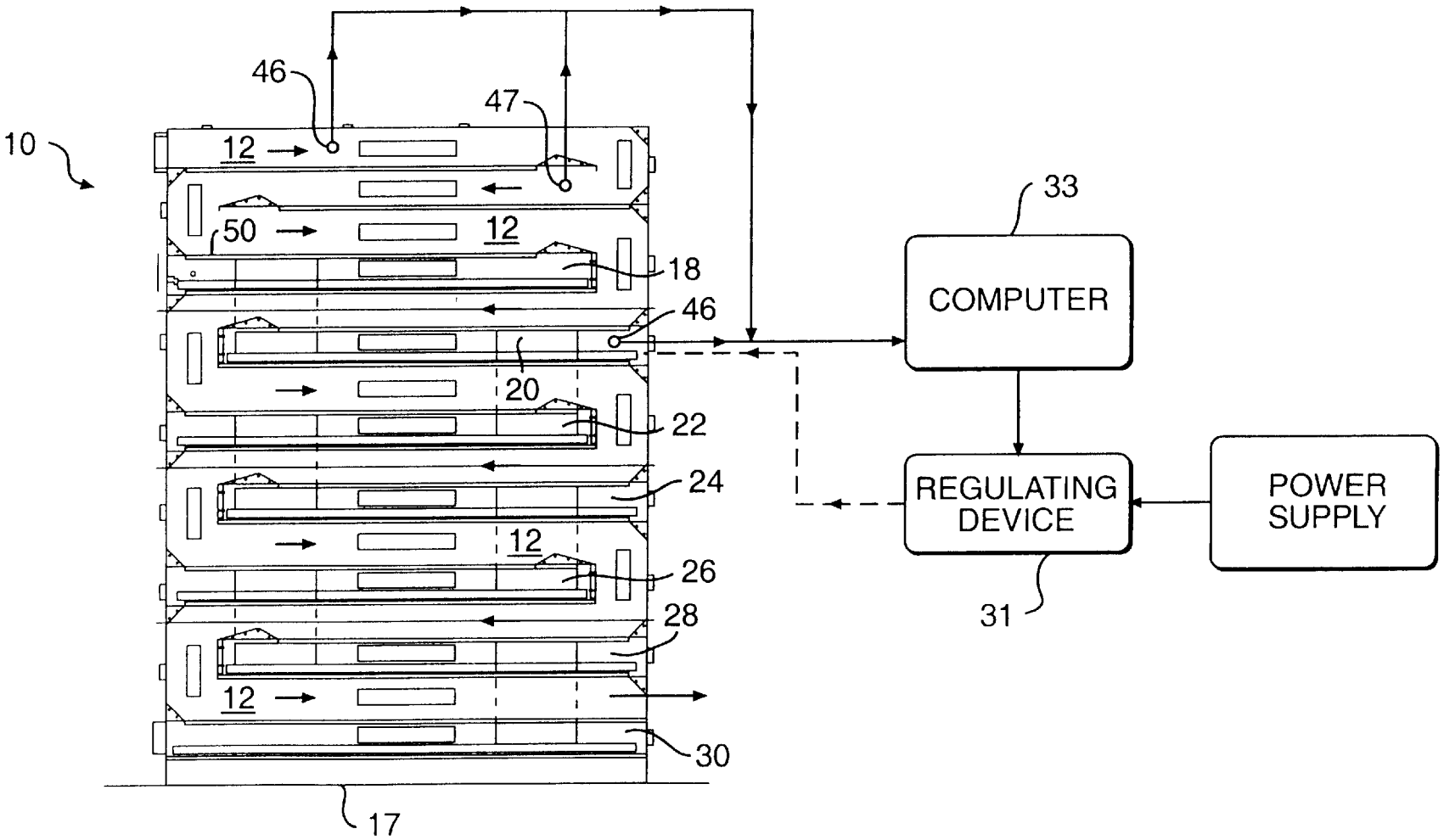
FIG. 7 is diagrammatic view of the hot shelf tower dryer with a computer and a regulating device as incorporated in the present invention.

As depicted in FIG. 7, a control system may be included to regulate the power conveyed to electrical heating elements 32 to ensure that the heat transferred from chambers 18–30 creates a substantially constant temperature for the heated forced air throughout passage 12. The control system utilizes at least one temperature measuring device 46 and computer 33. Temperature measuring device 46 is disposed in passage 12 and/or chambers 18–30. In situations where multiple temperature measuring devices 46 are used, temperature measuring devices 46 are disposed in both passage 12 and chambers 18–30. Typical temperature measuring devices 46 include a thermometer or thermocouple.

Generally, the control system regulates power to electrical heating elements 32 in relation to the temperature measured by temperature measuring device 46. As depicted in FIG. 7, once the temperature is measured by temperature measuring device 46, it is received by computer 33 and processed. In response to the output of a computer program, regulating switch 31 automatically increases or decreases power supply 35 to electrical heating elements 32 so that chamber 18 maintains a desired temperature.

The control system may further include one or more humidity sensing devices 47 for measuring the increased moisture content in the heated air resulting from the evaporation of moisture from the seed cotton. In such a system, the computer performs calculations dependent upon temperature and humidity as recorded by temperature measuring device 46 and humidity sensing devices 47. As such, the control system regulates power to electrical heating element 32 in relation to the temperature and humidity of the heated air.

To ensure that the heated forced air traveling through passage 12 maintains a desired temperature distribution throughout, temperature measuring devices 46 are strategically disposed throughout tower casing 10. As illustrated in FIG. 1, temperature measuring devices 46 are preferably disposed in passage 12, proximate to inlet 14, proximate to outlet 16 and several points therebetween, and in each of the seven chambers 18–30. Because the temperature measuring devices, as dispersed, provide computer 33 with a sufficient range of temperature readings, the control system can maintain the desired temperature range for the heated forced air throughout passage 12.

Figure 4:
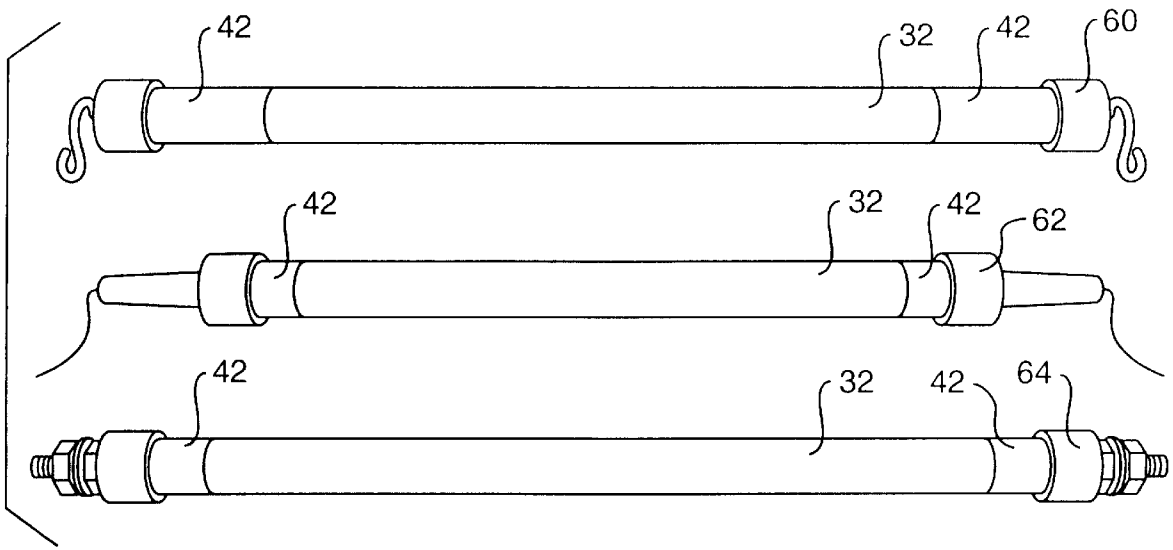
FIG. 4 is a side view illustration of different embodiments of an electrically-powered radiant heating element incorporated in the present invention.
Figure 5:
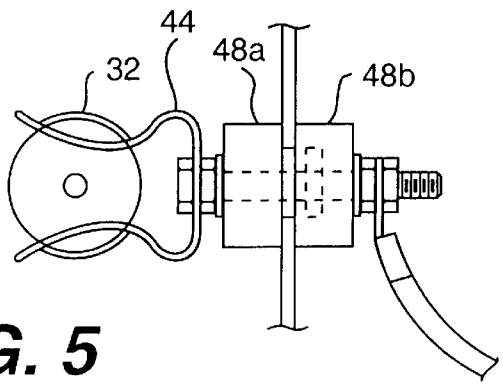
FIG. 5 is an end view illustration of one of the fuse clips for an electrically-powered radiant heating element, showing an insulator pair for securing one end of the electrically-powered radiant heating element incorporated in the present invention.
Figure 6:
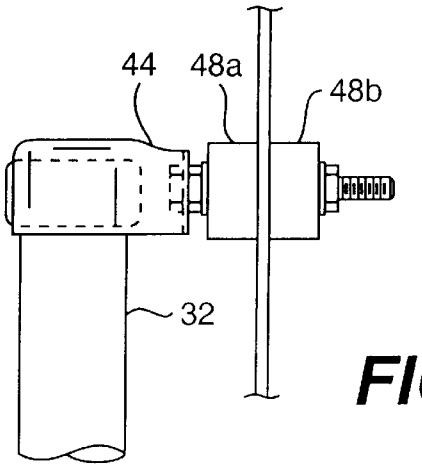
FIG. 6 is an end view of the fuse clip with the insulator pair illustrated in FIG. 5.

Electrical heating elements 32 are typically made of quartz and provided with gold ends 42, capable of withstanding temperatures of 600° F. or higher. As depicted in FIG. 4, end 42 of electrical heating element 32 combines with a fuse clip. FIG. 4 illustrates three different embodiments of fuse clip 60, 62, 64 as connected to an electrically-powered radiant heating element manufactured by Fannon Products of Detroit, Mich., under the trademark Goldenrod®. The fuse clips grasp and connect ends 42 of electrical heating element 32 to insulator pair 48*a*, 48*b*, depicted in FIGS. 5 and 6. In turn, insulator pair 48*a*, 48*b* secures electrical heating element 32 to chamber 18 by affixing it to either outer wall 34 or inner wall 36 of chamber 18. Because insulator pair 48*a*, 48*b* also conveys power to electrical heating element 32, insulator pair 48*a*, 48*b* should preferably affix to outer wall 34 so that the power leads are easily accessible to the external portions of tower casing 10.

The inclusion of electrical heating elements 32 in chambers 18–30 significantly improves the transfer of heat to the shelves, and thus also to the heated air and cotton traveling over the surfaces of the shelves. Electrical heating elements 32 also may provide an even distribution of heat throughout tower casing 10. In contrast to the conventional practice of providing drying air, heated elsewhere, to chambers 18–30, electrical heating elements 32 reside in chambers 18–30 and emit an easily controlled amount of heat.

Individual electrical heating element 32 requires virtually no heat-up time and only requires power when heat is necessary. Presently, electrical heating element 32 attains its full temperature in approximately fifteen seconds. In hot shelf tower dryers where a plurality of electrical heating elements 32 are disposed in chambers 18–30, electrical heating elements 32 may be regulated as a system or individually. Such direct and expedient control ensures a desired distribution of heat throughout passage 12, which in turn corresponds to an efficient evaporation of moisture from the seed cotton.

As described previously, in situations requiring a variant temperature profile throughout tower casing 10, such individual control of electrical heating elements 32 may also provide the desired temperature profile. Instead of providing a particular chamber with additional electrical heating chambers 32, the power provided to an electrical heating element 32 in a particular chamber can be regulated so that it produces increased heat. Once again, such temperature profile design considerations will be apparent to those skilled in the art.

With the inclusion of electrical heating elements 32 in chambers 18–30 of tower casing 10, the conventional method and apparatus associated with circulating hot air through chambers 18–30 are no longer required, although the adaptability of the present invention allows their continued use. As a result, it is not necessary to generate additional hot air using conventional methods such as burning methane, natural gas, or other fossil fuels. Further still, instead of using the same conventional methods to supply heated forced air to inlet 14 of tower casing 10, the heated forced air may be generated by electrical heating elements 32. For example, as previously described, chamber 18 could include a fan and a sufficient number of additional electrical heating elements 32. The fan, as positioned, would compel a portion of the air heated by electrical heating elements 32 out of chamber 18 and towards inlet 14 through channel 40, as depicted in FIG. 9. Channel 40, including valve 42, controls the removal of heated air from chamber 18. Again, the hot shelf tower dryer may include one or more channels conveying heated air from one or more chambers to inlet 14. As such, the conventional methods of burning methane, natural gas, or other fossil fuels would no longer be necessary to any aspect of heating the forced air resident in the hot shelf tower dryer. Accordingly, the pollutant emissions from the hot shelf tower dryer may be either eliminated or at least significantly reduced.

It will be apparent to those skilled in the art that various modifications and variations can be made in the hot shelf tower dryer of the present invention and in the distribution of the electrically heating elements or the like without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A hot shelf tower dryer having a casing with opposed end walls, an inlet and a outlet, the hot shelf tower dryer comprising:

a plurality of shelves disposed in generally parallel spaced relation between the inlet and the outlet, each shelf alternately extending from one end wall to a location proximate the opposing end wall to define a convoluted path between the inlet and outlet, wherein at least two of the plurality of shelves include a chamber, each chamber having at least one heating element disposed therein for radiantly heating a portion of the path adjacent thereto.

2. The hot shelf tower dryer of claim 1, wherein at least one chamber includes a greater number of heating elements than another chamber to provide a variant temperature profile in the dryer.

3. A hot shelf tower dryer, having a casing with opposed end walls, an inlet and an outlet, the hot shelf tower dryer comprising:

a plurality of shelves disposed in generally parallel, spaced relation between the inlet and the outlet, each shelf alternately extending from one end wall to a location proximate the opposing end wall to define a convoluted path between the inlet and outlet, wherein at least two of the plurality of shelves include a chamber, each chamber having at least one heating element disposed therein;

a control system regulating power to the at least one heating element, wherein the control system includes at least one temperature measuring device for reading a temperature in the casing and for generating a temperature signal and a computer for receiving the temperature signal and for processing the temperature signal to regulate power to the at least one heating element to maintain an air temperature range within the tower casing, the control system regulating power to the heating elements of at least one chamber at an increased level to the heating elements of another chamber to provide a variant temperature profile in the dryer.

4. A hot shelf tower dryer having a casing with opposed end walls, an inlet and an outlet, the hot shelf tower dryer comprising:

a plurality of shelves disposed in generally parallel, spaced relation between the inlet and the outlet, each shelf alternatively extending from one end wall to a location proximate the opposing end wall to define a convoluted path between the inlet and the outlet;

at least one of the plurality of shelves including a chamber;

a plurality of electrical heating elements disposed in the chamber for radiantly heading a portion of the path adjacent thereto; and a channel proximately positioned between the chamber and the inlet to direct air heated in the at least one chamber to the inlet.

5. The hot shelf tower dryer of claim 4, wherein:

the channel includes a valve controllably regulating the amount of heated air directed to the inlet.

6. The hot shelf tower dryer of claim 5, wherein:

a fan assists in directing the air heated to the inlet, the fan positioned proximate to one of the inlet, the channel and the chamber.

7. The hot shelf tower dryer of claim 4, further comprising:

a plurality of channels, each channel proximately positioned between one chamber and the inlet.

8. A hot shelf tower dryer having a casing with opposed end walls, an inlet and an outlet, the hot shelf tower dryer comprising:

a plurality of shelves disposed in generally parallel, spaced relation between the inlet and the outlet, each shelf alternately extending from one end wall to a location proximate the opposing end wall to define a convoluted path between the inlet and outlet;

at least one of the plurality of shelves including a chamber;

at least one electrical heating element disposed in the chamber for radiantly heating a portion of the path adjacent thereto; and a channel proximately positioned between the chamber and the inlet to direct air heated in the at least one chamber to the inlet.

9. The hot shelf tower dryer of claim 8, wherein:

the channel includes a valve controllably regulating the amount of heated air directed to the inlet.

10. The hot shelf tower dryer of claim 9, wherein:

a fan assists in directing the heated air to the inlet, the fan positioned proximate to one of the inlet, the channel and the chamber.

11. The hot shelf tower dryer of claim 8, further comprising:

a plurality of channels, each channel proximately positioned between the chamber and the inlet.

* * * * *

UNITED STATES PATENT AND TRADEMARK OFFICE

CERTIFICATE OF CORRECTION

PATENT NO. 6,147,327

DATED: November 14, 2000

INVENTORS: William E. Winn

It is hereby certified that errors appear in the above-identified patent and that said Letters Patent is hereby corrected as shown below:

Title page, in the "Attorney, Agent, or Firm", change "Finnegan Henderson Farabow Garrett & Dunner, LLP" to --Finnegan, Henderson, Farabow, Garrett & Dunner, L.L.P.--.

Title page, Item [57], in the Abstract, line 15, change "dryer's" to --dryers--.

Claim 1, Col. 9, line 3, change "a outlet" to --an outlet--.

Claim 1, Col. 9, line 5, change "parallel" to --parallel,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*